US011090669B2

(12) United States Patent
Beer

(10) Patent No.: US 11,090,669 B2
(45) Date of Patent: Aug. 17, 2021

(54) DISPENSING SYSTEM FOR DISPENSING FLOWABLE MATERIALS, FLEXIBLE BAG OR POUCH FOR USE IN DISPENSING SYSTEM, AND METHODS OF FILLING DISPENSING BOTTLES AND DISPENSING FLOWABLE MATERIALS THEREFROM

(71) Applicant: Fres-co System USA, Inc., Telford, PA (US)

(72) Inventor: Jeffrey Scott Beer, Coopersburg, PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

(21) Appl. No.: 15/592,644

(22) Filed: May 11, 2017

(65) Prior Publication Data

US 2017/0348715 A1 Dec. 7, 2017

Related U.S. Application Data

(60) Provisional application No. 62/346,640, filed on Jun. 7, 2016.

(51) Int. Cl.
*B05B 11/04* (2006.01)

(52) U.S. Cl.
CPC ..... *B05B 11/047* (2013.01); *B05B 11/048* (2013.01)

(58) Field of Classification Search
CPC ..... B05B 11/048; B05B 11/047; B65D 47/32; B65D 1/32; B65D 47/2031; B65D 83/0055; B65D 75/5855; B65D 41/04; A61J 9/00
USPC .... 222/494, 212, 105, 386.5, 209; 215/11.3, 215/11.5
See application file for complete search history.

(56) References Cited

U.S. PATENT DOCUMENTS

| | | | | |
|---|---|---|---|---|
| 2,608,320 A * | 8/1952 | Harrison, Jr. ..... | B65D 83/0055 222/107 |
| 2,804,995 A * | 9/1957 | Fee ..... | B65D 83/0055 215/12.1 |
| 3,592,365 A * | 7/1971 | Schwartzman .... | B65D 47/2075 222/209 |
| 4,098,434 A * | 7/1978 | Uhlig ..... | B65D 83/0055 222/105 |
| 4,469,250 A | 9/1984 | Evezich | |

(Continued)

OTHER PUBLICATIONS

FIFO Bottle (TM) website page at http://www.fifobottle.com/ Bottles printed on Sep. 13, 2017.

*Primary Examiner* — Vishal Pancholi
*Assistant Examiner* — Robert K Nichols, II
(74) *Attorney, Agent, or Firm* — Caesar Rivise, PC

(57) ABSTRACT

A dispensing system, a flexible bag or pouch for use therewith, and methods for filling a dispensing bottle with a flowable product and dispensing the same are disclosed. The system includes a flexible bag and a dispensing bottle. The flowable product is located in the bag. The bag includes a first end and a second end. The bottle includes an interior chamber, a squeezable sidewall surrounding the chamber and a bottom cap including a dispensing valve. The bag is disposed in the chamber with the second end opened to form an open mouth, whereupon the flowable product is in communication with the dispensing valve. Squeezing of the bottle's sidewall applies pressure to the flowable product to cause it to be dispensed out of the bottle through dispensing valve.

17 Claims, 3 Drawing Sheets

(56) References Cited

U.S. PATENT DOCUMENTS

| | | | | | |
|---|---|---|---|---|---|
| 4,842,165 | A * | 6/1989 | Van Coney | B65D 47/2018 | 222/105 |
| 5,012,956 | A * | 5/1991 | Stoody | B65D 83/0055 | 222/206 |
| 5,385,251 | A * | 1/1995 | Dunn | A61J 9/001 | 215/11.1 |
| 6,305,577 | B1 * | 10/2001 | Fillmore | B05B 11/0043 | 222/105 |
| 6,364,163 | B1 * | 4/2002 | Mueller | B05B 11/048 | 222/105 |
| 6,446,822 | B1 * | 9/2002 | Meyers | A61J 9/001 | 215/11.3 |
| 8,408,426 | B2 * | 4/2013 | Bakhos | B65D 47/2018 | 222/105 |
| 8,960,502 | B2 | 2/2015 | Stehli, Jr. et al. | | |
| 2012/0312839 | A1 * | 12/2012 | Stehli, Jr. | B65D 83/0055 | 222/184 |

* cited by examiner

Fig. 1
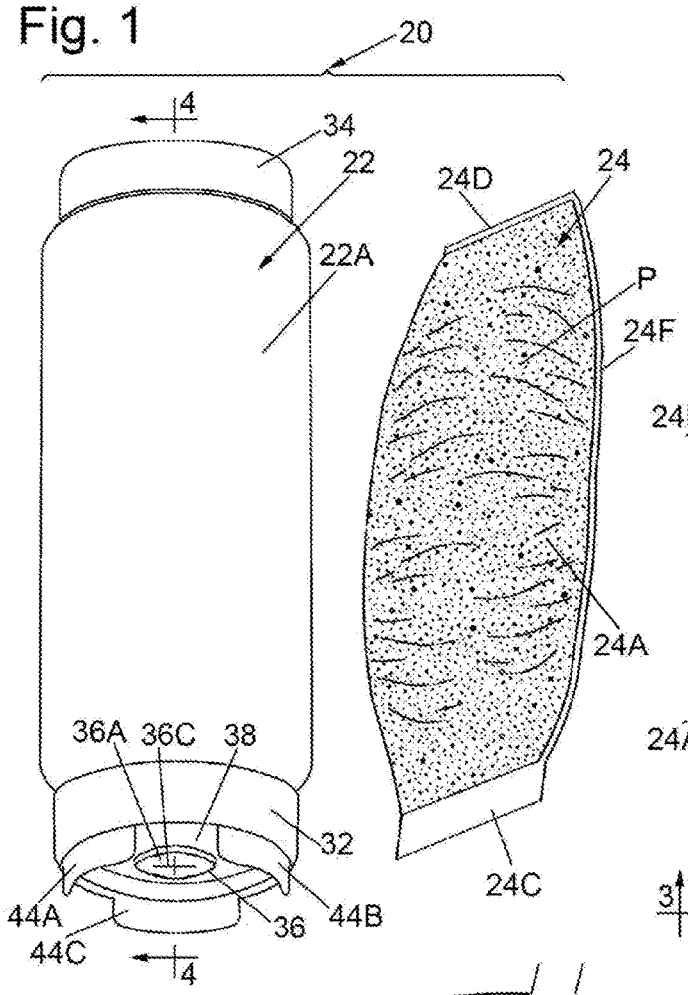
Fig. 2
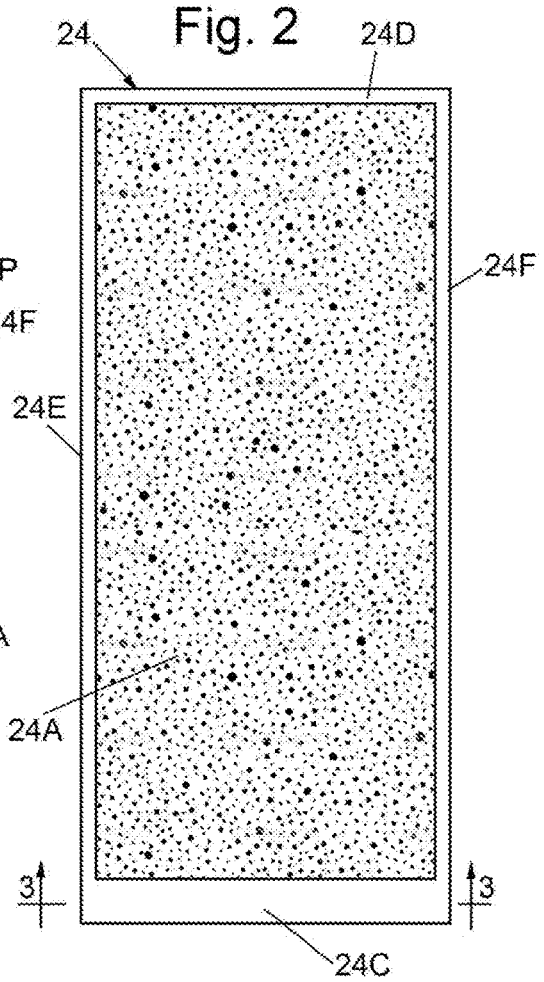
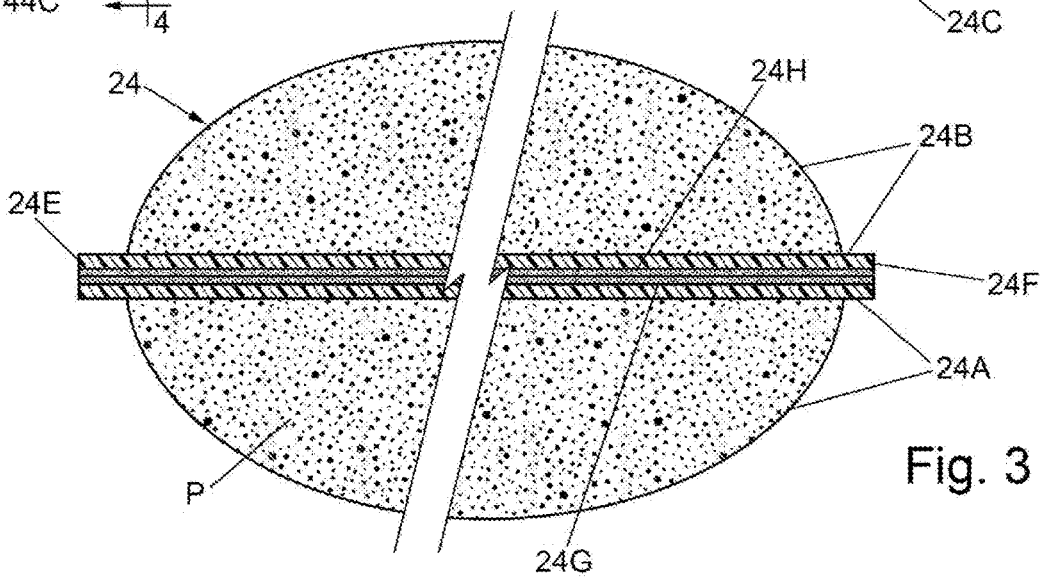
Fig. 3

DISPENSING SYSTEM FOR DISPENSING FLOWABLE MATERIALS, FLEXIBLE BAG OR POUCH FOR USE IN DISPENSING SYSTEM, AND METHODS OF FILLING DISPENSING BOTTLES AND DISPENSING FLOWABLE MATERIALS THEREFROM

CROSS-REFERENCE TO RELATED APPLICATIONS

This application claims priority from provisional application: Ser. No. 62/346,640, filed on Jun. 7, 2016, entitled Dispensing System For Dispensing Flowable Materials And Methods of Dispensing Flowable Materials, whose disclosure is specifically incorporated in its entirety by reference herein and which application is assigned to the same assignee as this invention.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

BACKGROUND OF THE INVENTION

This invention relates to dispensing systems and more particularly to squeeze bottles for dispensing flowable materials, such as sauces, condiments, etc., and methods of dispensing flowable materials from such bottles Squeeze bottles for dispensing a variety of sauces and condiments are commonly used in food service operations. These bottles are sometimes purchased pre-filled and are disposed of when empty. This is expensive and wasteful since these bottles are made from heavy plastic materials. Simple refillable bottles are also in use. These allow the food service company to purchase products in bulk and refill the dispensing bottle as needed. The downside to this is the need to clean these bottles for reuse. In addition, the bottles may just be topped off with new product leaving residual old product in the bottom which could be a health hazard. A dispensing device sold under the trademark FIFO BOTTLE™ by Fifo Innovations, #107-2999 Underhill Ave., Burnaby, British Columbia, Canada V5A 3C2 and as shown on the website www.fifobottle.com is the form of a squeezable hollow bottle adapted to have a flowable material introduced into it through a removable cap at the top of the bottle. The bottle includes a one-way silicone valve at the bottom of the bottle through which the flowable product is dispensed when the bottle is squeezed. The cap includes a one way valve that allows outside air to enter the bottle. In use, the bottle is squeezed, which creates pressure on the product, whereupon the product is forced out of the bottom valve. When the bottle is released air enters the bottle through the top valve to replace the volume of product that has exited the bottle. This arrangement allows the user to fill the FIFO BOTTLE™ from bulk into the top and then dispense product from the bottom and hence appears to be an improvement over the standard refillable bottle.

While that bottle and other fill/bottom dispense systems are generally suitable for their intended purposes they nevertheless leave much to be desired. In particular, complaints about the top fill/bottom dispense system center around product losses. In particular, the valve system in these bottles requires cleaning. This can result in some product loss. The larger issue is product loss from some residual product being left in the bulk container. In this regard, a large amount of product may cling to the bulk container, thus increasing the time to empty the bulk container completely. The busy food service operator may throw away this bulk container before it is empty to save time. Another issue is product spoilage in the bulk container once the container is opened. Some sensitive products may spoil in the bulk container before it can be used.

U.S. Pat. No. 8,960,502 (Stehli, Jr. et al.) (hereinafter the "'502 Patent") discloses a dispenser system that includes a squeezable dispenser bottle and a container holding a flowable product for location within the bottle and which presumable is designed to overcome some of the disadvantages of top fill/bottom dispense systems. The bottle of the '502 Patent has a cap with a one-way dispensing valve at the bottom of the bottle and cap with a one-way air inlet valve at the top of the bottle. The container includes a flexible walled top portion, a more rigid walled bottom portion. The bottom of the container is openable, e.g., in one embodiment includes a removable cover, to provide access to the flowable product when the bottom is opened, e.g., the cover is removed. The flexible walled top portion forms an inversion tube. The container is located in the bottle with the openable end of the container located adjacent the dispensing valve such that the flowable product is in fluid communication with the dispensing valve when the bottom of the container is opened. Squeezing of the bottle squeezes the container, thereby causing the flowable product in the container to be ejected through the dispensing valve. During dispensing the inversion tube portion of the container inverts into the more rigid walled portion of the container as the flowable product is dispensed. Upon release of the bottle, air enters through the one-way valve to fill the bottle with air to replace the forced-out flowable contents and neutralize the pressure in the space between the container and the bottle.

While the system of the '502 Patent appears suitable for its intended purposes, it nevertheless leaves much to be desired from the standpoint of simplicity of construction, ease of use, ability to be readily cleaned.

Thus, a need exists for dispensing system including a bottle that is easy to fill with a flowable product and which facilitates dispensing of that product without wastage and requires minimal cleaning, if any, after use. The subject invention addresses that need by providing a dispensing system including a bottle and a flexible bag filled with a flowable product, which is simple in construction, easy to use, and effective to dispense the product from the bag through a dispensing valve in the bottle without wastage and which requires minimal cleaning, if any, of the bottle after use. Thus, the subject invention should improve food safety and reduce food waste by elimination open bulk containers and enable bottle cleaning to be simpler and faster in the event that the bottle's dispensing valve become fouled.

SUMMARY OF THE INVENTION

One aspect of this invention is a system for dispensing a flowable material from a bottle. The system comprises the flexible bag or pouch, and a dispensing bottle. The flexible bag or pouch comprises a body formed of a flexible material and bounding an interior space in which a flowable product is located. The flexible bag or pouch includes a first (e.g., top sealed) end and a second (e,g., bottom sealed) end. The bottle comprises a hollow container having a top end portion, a bottom end portion and a sidewall interposed therebetween and bounding an interior chamber. The bottom end portion of the bottle comprises a bottom cap releasably securable to the sidewall of the bottle and including a dispensing valve. The flexible bag or pouch is located in the interior chamber with the first end being opened to form an open mouth of the bag or pouch, such that the flowable product is in communication with the dispensing valve, whereupon squeezing of the sidewall of the bottle applies pressure to the flowable product within the flexible bag or pouch to cause it to be dispensed through the dispensing valve.

In accordance with one preferred aspect of the system of this invention the flexible bag or pouch comprises a peelable seal configured to be peeled open to form the mouth.

In accordance with another preferred aspect of the system of this invention portions of the bag or pouch contiguous with the open mouth are configured to be interposed and held between the bottom cap and the sidewall of the bottle.

In accordance with another preferred aspect of the system of this invention the dispensing valve comprises a one-way valve.

In accordance with another preferred aspect of the system of this invention the top end portion includes a one-way top valve configured to enable ambient air to enter through the one-way top valve to the interior chamber when the squeezing of the bottle is released to thereby fill the space within the interior chamber created by the dispensing of the flowable product from the bottle.

Another aspect of this invention is a flexible bag or pouch which is configured to be used in a dispensing system, like that set forth above.

Still another aspect of this invention is a method of filling a dispensing bottle with a flowable material. The method entails providing a flexible bag or pouch comprising a body formed of a flexible material and bounding an interior space in which a flowable product is located. The flexible bag or pouch has a first (e.g., top sealed) end and a second (e.g., bottom sealed) end. The dispensing bottle comprises a hollow container having a top end portion, a bottom end portion, and a sidewall interposed therebetween and bounding an interior chamber. The bottom end portion of the bottle comprises a bottom cap releasably securable to the sidewall of the bottle. The bottom cap includes a dispensing valve. The flexible bag or pouch is introduced into the interior chamber through the bottom end portion of the bottle whereupon the first end of the flexible bag or pouch is located adjacent the top portion of the bottle and the second end of the flexible bag or pouch is located adjacent the bottom portion of the bottle. The second end of the flexible bag or pouch is opened to form a mouth of the flexible bag or pouch. A bottom cap having a bottom valve is releasably secured to the sidewall of the bottle such that the flowable product in the flexible pouch is in communication with the bottom valve via the mouth of the flexible bag or pouch and with portions of the mouth of the bag or pouch tightly sandwiched between the bottom cap and the sidewall of the bottle.

In accordance with another aspect of this invention after the bottle is filled as set forth above, the sidewall of the bottle can then be squeezed to apply pressure to the flowable material within the flexible bag or pouch to cause the flowable material be dispensed through the dispensing valve.

In accordance with still another aspect of the method of this invention the bottom cap is removed from the bottle after the flowable product has been dispensed from the bottle. The mouth of the flexible bag or pouch can then be grasped and pulled to remove the flexible bag or pouch from the interior chamber of the bottle.

DESCRIPTION OF THE DRAWING

FIG. 1 is an isometric view of one exemplary dispensing system constructed in accordance with this invention, that system basically comprising a dispensing bottle and a flexible bag or pouch holding a flowable product for disposition within the dispensing bottle so that the flowable material can be dispensed from the bag or pouch by squeezing the bottle;

FIG. 2 is a slightly enlarged top plan view of the flexible bag or pouch forming a portion of the system shown in FIG. 1;

FIG. 3 is an enlarged sectional view taken along line 3-3 of FIG. 2;

DETAILED DESCRIPTION OF THE PREFERRED EMBODIMENT

Figure 4:
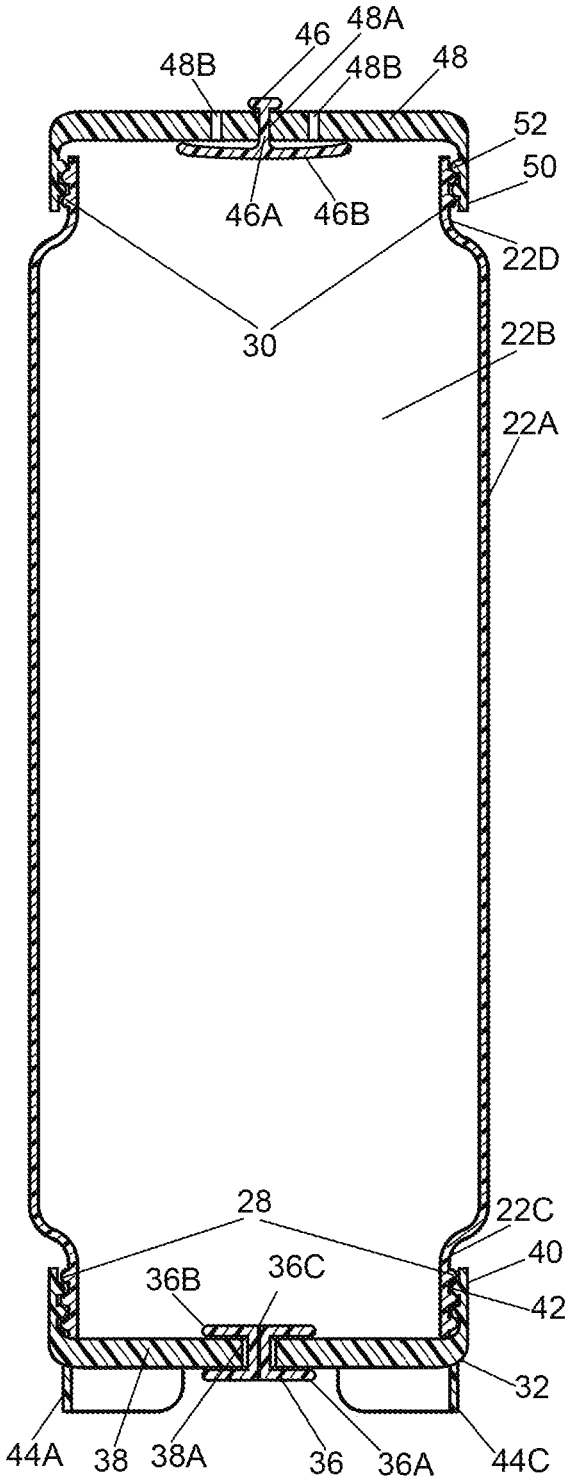
FIG. 4 is an enlarged vertical sectional view of the dispensing bottle taken along line 4-4 of FIG. 1.

Referring now to the various figures of the drawing wherein like reference characters refer to like parts, there is shown at 20 in FIG. 1 one exemplary embodiment of a top fill/bottom dispense system constructed in accordance with this invention. The system 20 basically comprises a bottle 22 and a flexible bag or pouch 24. The bag or pouch 24 contains a flowable product P, such as a condiment, sauce, etc.

The bag or pouch is best seen in FIGS. 2 and 3 and is a thin, light-weight member formed from a sheet of flexible material. In the exemplary embodiment shown, the sheet of flexible material is rectangular in shape and comprises a front panel 24A and a back panel 24B. Each panel has a bottom edge 24C, a top edge 24D, a left side edge 24E and a right side edge 24F. The panels 24A and 24B are secured together along their edges 24C, 24D, 24E and 24F, to form hollow body in which the flowable product P is located. The sealing of the edges can be accomplished via various conventional means, e.g., thermal bonding, ultrasonic bonding, adhesive securement, etc. The bottom end, i.e., the portion of the panels 24A and 24B contiguous with the bottom edge 24C, forms an openable mouth of the bag or pouch. To that end, the material making up the mouth of the bag or pouch is in the form of a peelable seal, which can be formed by any suitable technique. For example, as best seen in FIG. 3, the inner surface of the sheet material or film making up the panels 24A and 24B may include a peelable coating 24G and 24H, respectively, thereon, or may include a composition that enables the mouth to be welded closed, but which can be peeled apart to open the mouth by simple hand manipulation. Irrespective how the openable mouth is formed, it is configured so that when the portions of the bottom end 24C of the bag or pouch are pulled apart to break the peelable seal that action opens the mouth to provide access to the interior of the bag or pouch and hence to the flowable product P located therein.

In accordance with one exemplary aspect of this invention the bag or pouch is formed by folding a sheet of any suitable flexible material in half bringing the left and right edges together to form a tube, with the back of the sheet forming the inside of the tube. Energy is then applied to the left and right edges to weld them together. Once that has been accomplished energy is applied to a first end of the tube, thereby welding the edges at that first end together to form a tube with a closed end. The tube is then oriented so that the closed end is facing downward, whereupon the flowable product P is filled into the tube through the opposite end of the tube which is open at that time. After the tube is filled that open end is releasably, e.g., peelably, sealed to complete the formation of the bag or pouch 24, with the end of the bag or pouch which had been releasably sealed forming the heretofore described openable, e.g., peelable, mouth of the bag or pouch.

The bottle 22 is best seen in FIGS. 1 and 4 is in the form of an elongated tubular body having a cylindrical sidewall 22A that constitutes a body of revolution surrounding the central longitudinal axis of the bottle. The sidewall is formed of any suitable material, e.g., a plastic or some other material that is somewhat flexible, so that it can be flexed inward and collapsed somewhat by a user squeezing the sidewall, as will be described later. The sidewall bounds a hollow internal cavity 22B. The bottom end of the sidewall is in the form of a neck 22C that includes external threads 28 thereon. The top end of the bottle is in the form of a neck 22D that includes external threads 30 thereon. The bottle also includes a bottom cap 32 and a top cap 34. The bottom cap 32 serves as the dispensing cap for the bottle and includes a one-way, dispensing valve 36 located at the center of a circular end wall 38 of the cap. A peripheral sidewall 40 extends about the periphery of the end wall 38. The sidewall 40 includes internal threads 42 configured for threaded releasable securement to the external threads 28 at the neck at the bottom end 22C of the sidewall 22A. The end wall 38 includes three downwardly projecting feet 44A, 44B and 44*c*C. The feet serve to support the bottle in the upright state, i.e., with the top end portion 22C extending upward, when the bottle is stored.

As will be described in detail later when the bottle is loaded with the flexible bag or pouch 24 and the mouth of the flexible bag or pouch is opened, the flowable product will be located at the bottom of the interior 24B of the bottle and in communication with one-way dispensing valve 36.

The one-way dispensing valve 36 is constructed to enable the flowable product P to be ejected through it from the bag or pouch when the bag or pouch is located within the interior 22B of bottle and the sidewall 22A of the bottle is squeezed. The valve 36 can be of any suitable construction. In the exemplary embodiment shown it is in the form of an X-valve formed of a resilient material, e.g., silicone, rubber, etc., having a central hub from which a pair of circular flanges 36A and 36B project outward. The hub is rod-like and located within a central hole 28A in the circular end wall 38 of the bottom cap 32, with the flange 36A tightly engaging the outer surface of the wall 38 contiguous with the opening 38A, and with the flange 36B tightly engaging the inner surface of the wall 38 contiguous with the opening 38A. The valve 36 includes an X-shaped slit 36C (FIG. 1) extending through the hub from the outer surface of the flange 36A to the outer surface of the flange 36B. The outer diameter of the hub of the valve 36 is smaller than the inner diameter of the opening 38A so that when pressure is applied to the sidewall A of the bottle during the dispensing operation the X-shaped slit 36C will open and the hub of the valve will expand outward in the opening 38A, like shown in FIG. 6, whereupon the flowable product P will be ejected or dispensed out of the bottle. It should be noted that the one-way dispensing valve, need not be an X-valve, like just described, but can be of any suitable type, e.g., a duck-bill valve, etc.

Figure 5:
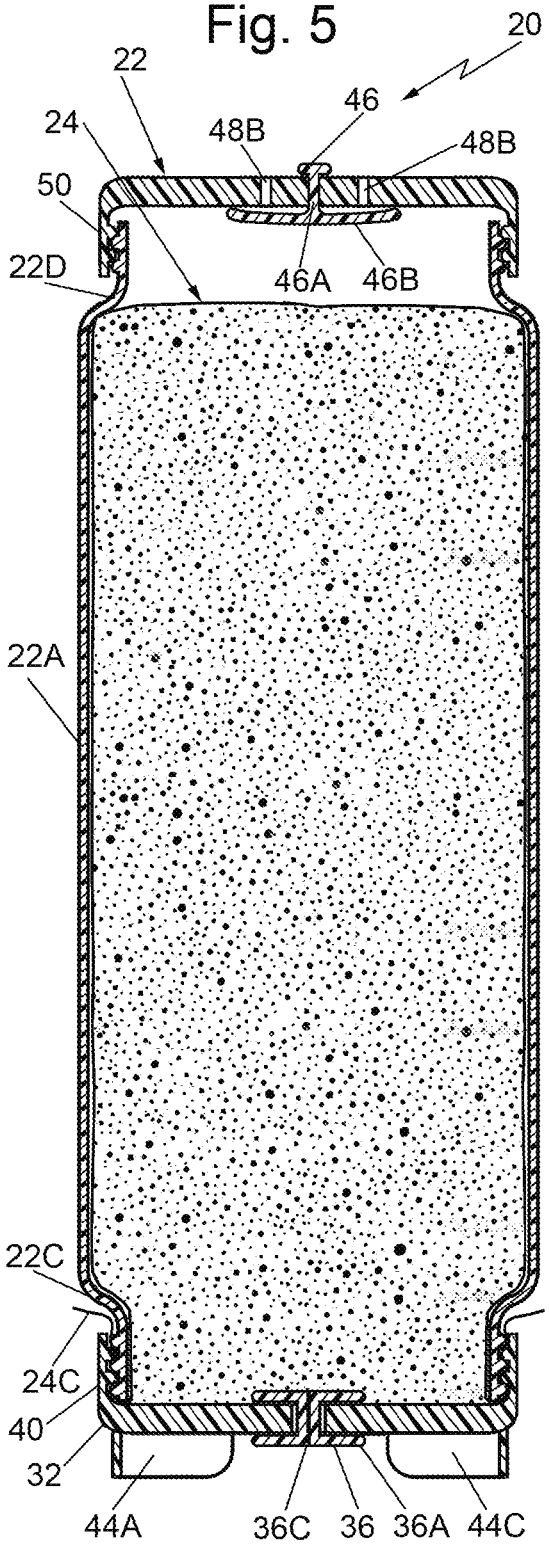
FIG. 5 is a vertical sectional view, like that of FIG. 4, but showing the dispensing bottle after the flexible bag or pouch has be disposed therein such that the system is ready to dispense the flowable product from the flexible bag or pouch.
Figure 6:
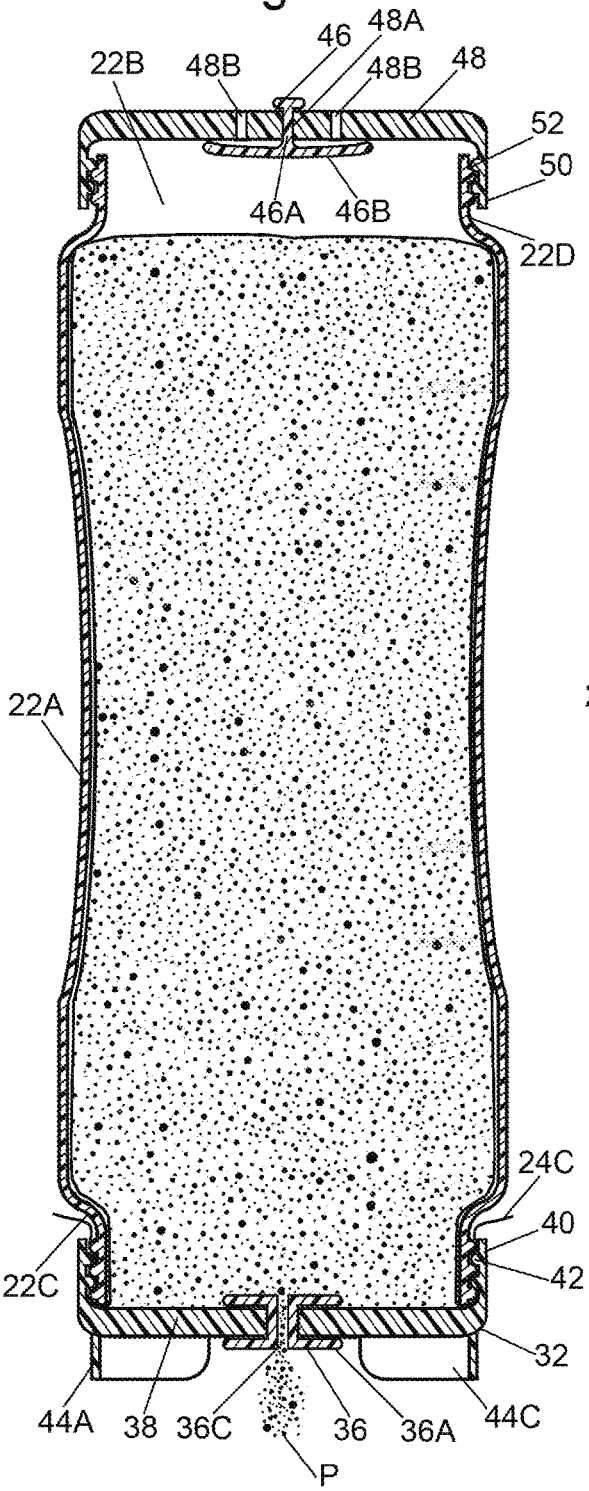
FIG. 6 is a vertical sectional view, like that of FIG. 5, but showing the dispensing system during the process of dispensing the flowable product by squeezing the bottle to force the flowable product in the pouch through a dispensing valve forming a portion of the bottle.

The top cap 34 includes a circular end wall 48 about which a peripheral sidewall 50 extends. The sidewall 50 includes internal threads 52 configured for threaded releasable securement to the external threads 30 at the neck at the top end 22D of the sidewall 22A. The end wall 48 includes a one-way air-inlet check valve 46 located at the center of the end wall 48. In the exemplary embodiment shown the valve 46 is of the "umbrella" type. In particular the valve 46 is formed of a resilient material, e.g., silicone, rubber, etc., having a central hub 46A from which an umbrella-shaped (dome-shaped) flange 46B projects outward. The central hub 46 is disposed within a central hole 48A in the circular end wall 48 of the top cap 34 so that the outer peripheral edge of the dome-shaped flange 46B engages the undersurface of the end wall 48, as shown in FIGS. 4-6. The end wall 48 of the cap includes plural apertures or vent holes 48B located radially outward from the central hole 48A, but within the perimeter of the outer periphery of the flange 46B. Thus, when the valve is in the state shown in FIGS. 4-6, i.e., its closed state, the vent holes 48B are isolated from the interior 22B of the bottle by the engagement of the peripheral edge of the flange 46B with the undersurface of the end wall 48.

Figure 7:
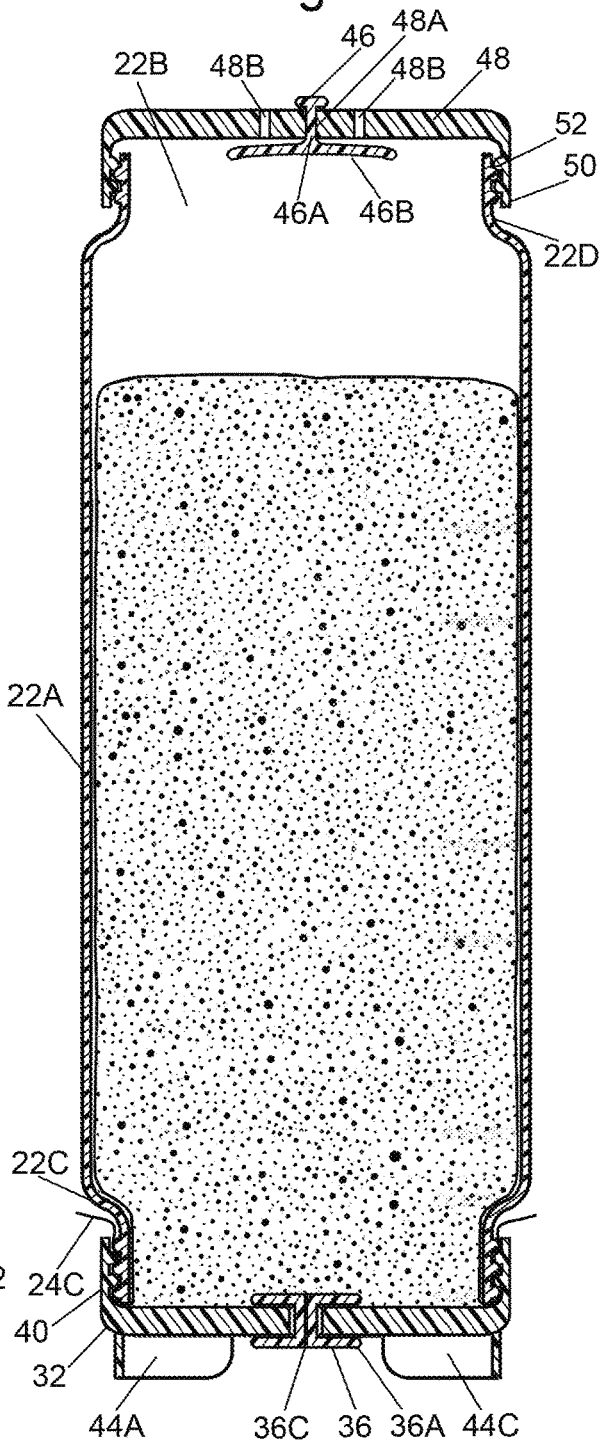
FIG. 7 is a vertical sectional view, like that of FIG. 6, but showing the dispensing system after the bottle has been released, e.g., un-squeezed, so that air can enter into the bottle via another one-way air valve to replace the volume of product dispensed.

The one-way valve 46 enables the contents of the bag or pouch to be in a vacuum state during the squeezing of the bottle so that the flowable product P is ejected or dispensed through the one-way valve 36 located in the lower cap 32 due to the internal pressure within the bag or pouch. When the bottle is released, i.e., the user stops squeezing its sidewall 22A, the internal pressure ceases so that no further flowable material is dispensed through the valve 36. In addition, the release of pressure on the sidewall of the bottle enables the air to enter the bottle via the one-way valve 46. That action neutralizes, i.e., fills, the space between the flexible bag or pouch 24 and the interior of the bottle as shown in FIG. 7. In addition, to providing that functionality, the one-way valve 46 acts as a check valve to prevents outside contaminates from entering the interior of the bottle during storage of the bottle.

It should be noted, that while the preferred embodiment of the valve 46 is an umbrella valve, that is merely exemplary. Thus, any other type of one-way valve can be used, e.g., a butterfly valve, a duck-bill valve, etc. It should also be pointed out that while the one-way valve 46 is preferably located in the top cap 34, that arrangement is not mandatory. Thus, the one-way valve 46 may be located at a suitable position on the sidewall of the bottle, where it is not likely to be obstructed. In fact the top end of the bottle need not include a releasably securable cap, but rather may include an end wall that is fixedly secured to the sidewall.

Use of the dispenser system 20 is as follows. The bottom cap 32 is removed from the bottle by unscrewing it and the bottle is inverted so that the neck at the now opened bottom end is facing upward. The bag or pouch is then introduced into the interior 22B of the bottle through the neck at the open end 22C so that the mouth 24C of the bag or pouch is located adjacent the open end 22C with the opposite end of the bag or pouch located adjacent the cap 34. The peelable mouth of the bag or pouch is then peeled open by hand by the user and the portions of the bag or pouch contiguous with the mouth are folded back (turned inside-out) over the outer surface of the neck at the now open end 22C of the bottle. The cap 32 is then screwed tightly in place onto the threads 40 at that neck of the bottle, with the portions of the mouth of the bag interposed between the cap and the neck of the bottle as shown in FIG. 5. The bottle with the bag or pouch in it is then inverted so that the dispensing valve 36 is facing downward and whereupon the flowable product will be in fluid communication with that valve. The system is now ready for use to dispense the flowable product P. In particular, when the sidewall of the bottle is squeezed, pressure is applied to the bag or pouch which in turn applies pressure to the product thus forcing it out through the valve 36 in the bottom cap. When pressure on the sidewall of the bottle is released, outside air enters the bottle via the valve 46 into the space between the bottle and the bag or pouch to refill the space with air making up for the volume of product that was dispensed. When the bag or pouch is empty, i.e., its entire contents P have been dispensed, the bottom cap is removed and the empty bag or pouch is removed from the bottle. The bottle and bottom cap remain clean as they have only contacted the bag or pouch and not the flowable product P. The bottom cap and its valve can then be cleaned and a new bag or pouch 24 inserted into the bottle 22 in the same manner as described above.

It must be pointed out at this juncture that the exemplary flexible bag or pouch as described above is merely one of various types of flexible packages that can be used in the system of this invention. Thus, other flexible packages, can be used so long as they include some openable mouth that can be folded back or turned inside out to fit between the bottle and a dispensing cap having some one-way valve, whereupon the flowable contents of the package are in fluid communication with the one way valve. Moreover, as stated earlier the bottle need not make use of a removable cap at the opposite end of the dispensing cap. Further still, the dispensing cap need not be threadedly releasably securable to the bottle, but can be securable by other releasable means, e.g., a bayonet fitting, some clamp mechanism, etc. Other changes and modifications to the structure and arrangement of the components making up the system of this invention and the method of dispensing a flowable product in accordance with this invention are also contemplated.

Without further elaboration the foregoing will so fully illustrate my invention that others may, by applying current or future knowledge, adopt the same for use under various conditions of service.

What is claimed is:

1. A system for dispensing a flowable product comprising:

a single flexible bag or pouch having a first end, a second end, and a length between said first end and said second end, said flexible bag or pouch being formed of a front panel and a back panel, each of said panels having a right side edge, a left side edge, a top edge, a bottom edge and a length measured between said top edge and said bottom edge, each of said panels being formed from a sheet of a flexible material secured together along said edges to form an integral hollow body having a sidewall bounding an interior space in which a flowable product may be located, whereupon the interior space in its entirety is capable of being directly engaged by said flowable product;

a bottle having a base configured to be located on a surface to support said bottle in an upright state for storage, said bottle comprising a hollow container having a central longitudinal axis, a top end portion, a bottom end portion and a sidewall interposed between said top end portion and said bottom end portion and bounding an interior chamber, said sidewall being continuous without any opening or aperture therein;

a one-way valve located at said top end portion of said bottle and exposed to the ambient atmosphere at all times, irrespective of the orientation of said bottle, said one-way valve being configured to enable ambient air to enter through said one-way valve to said interior chamber and be in direct contact with said flexible bag or pouch when the squeezing of said bottle is released to thereby fill the space within said interior chamber created by the dispensing of said flowable product from said bottle; and a bottom cap located at said bottom end portion, opposite said top end portion, and forming said base, said bottom cap being releasably securable to said sidewall of said bottle and including an end wall from which plural feet project downward and a dispensing valve located within said end wall and directed downward when said bottle is in said upright state, each of said feet having a bottom located below said dispensing valve and configured to support said bottle on said surface in said upright state, said flexible bag or pouch being received within said interior chamber with said second end being opened to form an open mouth of the bag or pouch, whereupon said flowable product is in communication with said dispensing valve via said mouth, said bottle being configured to be lifted off of said surface to dispense said flowable product from said bottle by squeezing of said sidewall of said bottle to apply pressure to said flowable product within said flexible bag or pouch to cause said sidewall to collapse inward radially toward said central longitudinal axis, whereupon said flowable product is dispensed out of said bottle through said downwardly directed dispensing valve.

2. The system of claim 1 wherein said second end of said flexible bag or pouch comprises a peelable seal configured to peeled open to form said open mouth.

3. The system of claim 2, wherein said sidewall of said bottle extends between said top end portion and said bottom end portion, is cylindrical and has an outer surface and an inner surface, said inner surface of said sidewall of said bottle bounding said interior chamber, wherein said bottom cap includes a cylindrical sidewall and said dispensing valve, said cylindrical sidewall of said bottom cap having an inner surface, an wherein a portion of said flexible bag or pouch contiguous with said open mouth is configured to be interposed and held between said inner surface of said cylindrical sidewall of said bottom cap and said outer surface of said cylindrical sidewall of said bottle.

4. The system of claim 1, wherein said sidewall of said bottle extends between said top end portion and said bottom end portion, is cylindrical and has an outer surface and an inner surface, said inner surface of said sidewall of said bottle bounding said interior chamber, wherein said bottom cap includes a cylindrical sidewall and said dispensing valve, said cylindrical sidewall of said bottom cap having an inner surface, an wherein a portion of said flexible bag or pouch contiguous with said open mouth is configured to be interposed and held between said inner surface of said cylindrical sidewall of said bottom cap and said outer surface of said sidewall of said bottle.

5. The system of claim 1 wherein said dispensing valve comprises a one-way valve.

6. The system of claim 1 wherein said top end portion of said bottle comprises a top cap releasably securable to said sidewall, said top cap including said one- way valve.

7. A method of filling a dispensing bottle with a flowable product comprising:

providing a single flexible bag or pouch having a first end, a second end, and a length between said first end and said second end, said flexible bag or pouch being formed of a front panel and a back panel, each of said panels having a right side edge, a left side edge, a top edge, a bottom edge and a length measured between said top edge and said bottom edge, each of said panels being formed from a sheet of a flexible material secured together along said edges to form an integral hollow body having a sidewall bounding an interior space in which a flowable product may be located, whereupon said interior space in its entirety is capable of being directly engaged by said flowable product;

filling at least a portion of said interior space with said flowable product;

providing a dispensing bottle having a base configured to be located on a surface to support said bottle in an upright state for storage, said bottle comprising a hollow container having a top end portion, a bottom end portion and a sidewall interposed between said top end portion and said bottom end portion and bounding an interior chamber, said sidewall being continuous without any opening or aperture therein, said sidewall having an outer surface and being configured to be collapsed by squeezing said outer surface of said sidewall, said bottle having a one-way valve located at said top end portion of said bottle and exposed to the ambient atmosphere at all times, irrespective of the orientation of said bottle;

introducing said flexible bag or pouch into said interior chamber through said bottom end portion of said bottle, whereupon said first end of said flexible bag or pouch is located adjacent said top portion of said bottle and said second end of said flexible bag or pouch is located adjacent said bottom portion of said bottle;

providing a bottom cap at said bottom end portion of said bottle, said bottom cap forming said base and being releasably securable to said sidewall of said bottle, said bottom cap including an end wall from which plural feet project downward and a dispensing valve located within said end wall and directed downward when said bottle is in said upright state, each of said feet having a bottom located below said dispensing valve and configured to support said bottle on said surface in said upright state, said bottle being configured to be lifted off of said surface to dispense said flowable from said bottle;

opening said second end of said flexible bag or pouch to form an open mouth of said flexible bag or pouch;

interposing portions of said bag or pouch contiguous with said open mouth between said bottom cap and said sidewall of said bottle; and releasably securing a bottom cap to said sidewall of said bottle so that said interposed portions of said open mouth are tightly sandwiched between said bottom cap and said sidewall and said flowable product is in communication with said dispensing valve.

8. The method of claim 7 additionally comprising:

lifting said bottle off of said surface to dispense said flowable material therefrom by squeezing said outer surface of said sidewall of said bottle to apply pressure to said flowable product within said flexible bag or pouch to cause said sidewall to collapse inward radially toward said central longitudinal axis, whereupon said flowable product is dispensed out of said bottle through said downwardly directed dispensing valve.

9. The method of claim 8 additionally comprising removing said bottom cap from said bottle after said flowable product has been dispensed from said bottle and grasping portions of the flexible bag or pouch contiguous with said mouth to remove said flexible bag or pouch from said interior chamber.

10. The method of claim 9 wherein:

said bottle is oriented such that said lower end of said bottle is directed upward when said flexible bag or pouch is introduced into said interior chamber; and orienting said bottle such that said lower end of said bottle is directed generally downward when said outer surface of said sidewall of said bottle is squeezed to dispense the flowable product through said dispensing valve.

11. The method of claim 8 wherein said one-way valve is configured to enable ambient air to enter through said one-way valve to said interior chamber and be in direct contact with said flexible bag or pouch when the squeezing of said outer surface of said sidewall of said bottle is released to thereby fill the space within said interior chamber created by the dispensing of said flowable product from said bottle.

12. The method of claim 7 wherein second end of said flexible bag or pouch comprises a peelable seal and wherein opening said second end of said flexible bag or pouch is achieved by peeling said peelable seal open to form said open mouth.

13. The method of claim 7 wherein said bottle is oriented such that said lower end of said bottle is directed upward when said flexible bag or pouch is introduced into said interior chamber.

14. The method of claim 7 wherein second end of said flexible bag or pouch comprises a peelable seal and wherein opening said second end of said flexible pouch is achieved by peeling said peelable seal open to form said mouth.

15. The method of claim 7 wherein said sidewall of said bottle extends between said top end portion and said bottom end portion, is cylindrical and has an outer surface and an inner surface, wherein said inner surface of said sidewall of said bottle bounds said interior chamber, wherein said bottom cap includes a cylindrical sidewall having an inner surface, and wherein said interposing portions of said bag or pouch contiguous with said open mouth between said bottom cap and said sidewall of said bottle comprises interposing a portion of said flexible bag or pouch contiguous with said open mouth between said inner surface of said cylindrical sidewall of said bottom cap and said outer surface of said cylindrical sidewall of said bottle.

16. A system for dispensing a flowable product comprising:

a single flexible bag or pouch having a first end, a second end, and a length between said first end and said second end, said flexible bag or pouch being formed of a front panel and a back panel, each of said panels having a right side edge, a left side edge, a top edge, a bottom edge and a length measured between said top edge and said bottom edge, each of said panels being formed from a sheet of a flexible material secured together along said edges to form an integral hollow body having a sidewall bounding an interior space in which a flowable product may be located, whereupon the interior space in its entirety is capable of being directly engaged by said flowable product;

a bottle having a base configured to be located on a surface to support said bottle in an upright state for storage, said bottle comprising a hollow container having a central longitudinal axis, a top end portion, a bottom end portion and a sidewall interposed between said top end portion and said bottom end portion and bounding an interior chamber, said sidewall being continuous without any opening or aperture therein;

a one-way valve located at said top end portion of said bottle and exposed to the ambient atmosphere at all times, irrespective of the orientation of said bottle, said one-way valve being configured to enable ambient air to enter through said one-way valve to said interior chamber and be in direct contact with said flexible bag or pouch when the squeezing of said bottle is released to thereby fill the space within said interior chamber created by the dispensing of said flowable product from said bottle; and a bottom cap located at said bottom end portion, opposite said top end portion, and forming said base, said bottom cap being releasably securable to said sidewall of said bottle and including an end wall from which plural feet project downward and a dispensing valve located within said end wall and directed downward when said bottle is in said upright state, each of said feet having a bottom located below said dispensing valve and configured to support said bottle on said surface in said upright state, said dispensing valve being a one-way valve comprising an X-valve formed of a resilient material having a central hub from which a pair of circular flanges project outward, said flexible bag or pouch being received within said interior chamber with said second end being opened to form an open mouth of the bag or pouch, whereupon said flowable product is in communication with said dispensing valve via said mouth, said bottle being configured to be lifted off of said surface to dispense said flowable product from said bottle by squeezing of said sidewall of said bottle to apply pressure to said flowable product within said flexible bag or pouch to cause said sidewall to collapse inward radially toward said central longitudinal axis, whereupon said flowable product is dispensed out of said bottle through said downwardly directed dispensing valve.

17. The system of claim 16 wherein said one-way valve located at said top end portion of said bottle comprises a central portion from which an umbrella-shaped flange projects outward.

* * * * *